United States Patent [19]

Hashimoto et al.

[11] 4,421,416

[45] Dec. 20, 1983

[54] SPEECH SYNTHESIZER TIMEPIECE WITH A SINGLE COMMAND SWITCH

[75] Inventors: Shintaro Hashimoto, Ikoma; Akitaka Morita, Nara; Hiroshi Tsuda, Uji, all of Japan

[73] Assignee: Sharp Kabushiki Kaisha, Osaka, Japan

[21] Appl. No.: 236,067

[22] Filed: Feb. 19, 1981

[30] Foreign Application Priority Data

Feb. 19, 1980 [JP] Japan ..... 55-20873[U]

[51] Int. Cl.[3] ..... G04B 21/08; G04F 8/00

[52] U.S. Cl. ..... 368/63; 368/111; 381/51

[58] Field of Search ..... 368/63, 111, 113, 250–251; 179/1 SM; 364/710

[56] References Cited

U.S. PATENT DOCUMENTS

| | | | |
|---|---|---|---|
| 3,998,045 | 12/1976 | Lester | 368/63 |
| 4,266,096 | 5/1981 | Inoue et al. | 368/63 X |
| 4,270,200 | 5/1981 | Stechmann et al. | 368/250 |
| 4,279,030 | 7/1981 | Masuzawa et al. | 368/63 |

*Primary Examiner*—Vit W. Miska

*Attorney, Agent, or Firm*—Birch, Stewart, Kolasch & Birch

[57] ABSTRACT

In an aspect of the present invention, a speech synthesizer timepiece is provided which is easy and convenient to handle by providing a single common switch useful for starting the timekeeping operation, outputting the results of the timekeeping and delivering an audible indication of the results of the timekeeping.

2 Claims, 2 Drawing Figures

SPEECH SYNTHESIZER TIMEPIECE WITH A SINGLE COMMAND SWITCH

BACKGROUND OF THE INVENTION

This invention relates to a speech synthesizer timepiece capable of providing an audible indication of time information.

In the past, timepieces capable of providing an audible indication of time information were proposed, which had a start/stop key (for use as a stopwatch) and a sound key (for delivery of an audible indication). However, provided that the stopwatch key and the sound key were separate and discrete, the user would look at a key input section to confirm which of the keys to depress. This is inconvenient for use as a stopwatch by which the user wishes to audibly confirm the results of timekeeping while tracing a moving object. In other words, the user would first visually confirm which of the keys to depress and then manually depress the selected key and hear an audible indication of the results of the timekeeping.

OBJECTS AND SUMMARY OF THE INVENTION

Accordingly, it is an object of the present invention to provide a speech synthesizer timepiece which provides ease of key operations.

It is another object of the present invention to provide a speech synthesizer timepiece which is easy and convenient to operate by providing a single common switch useful for starting a timekeeping operation, outputting the results of the timekeeping and delivering an audible indication of the results of the timekeeping.

BRIEF DESCRIPTION OF THE DRAWINGS

For a more complete understanding of the present invention and for further objects and advantages thereof, reference is now made to the following description taken in conjunction with the accompanying drawings, in which.

DETAILED DESCRIPTION OF THE INVENTION

Figure 1:
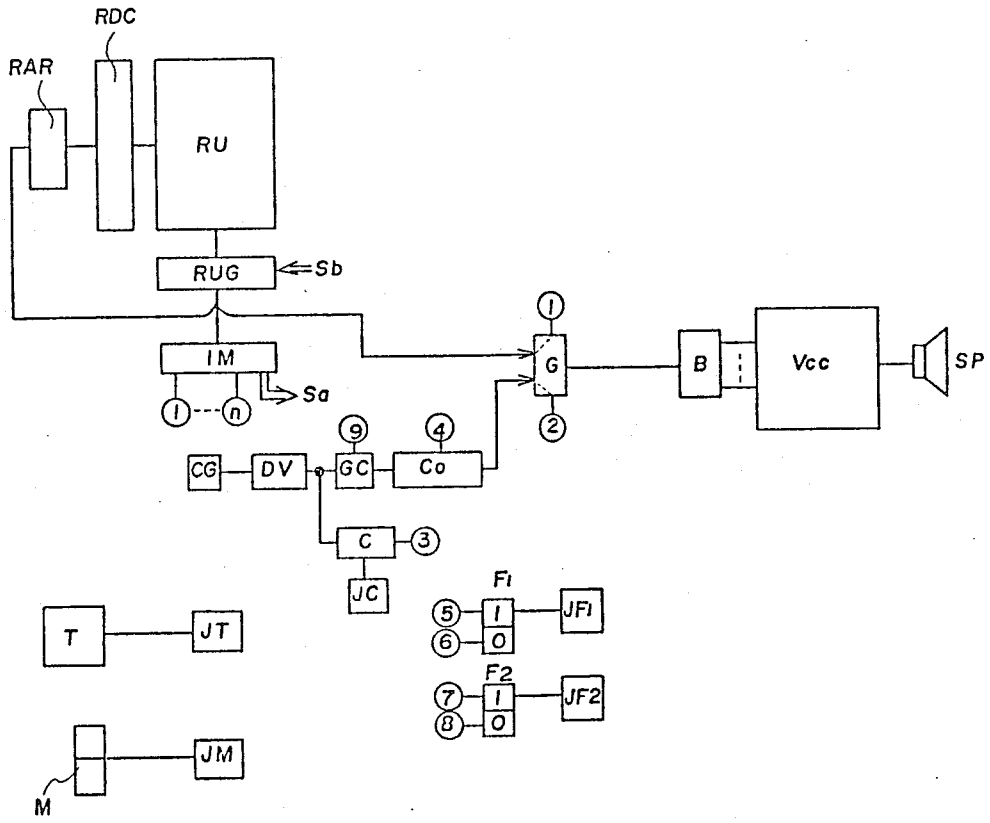
FIG. 1 is a block diagram of a speech synthesizer timepiece according to an embodiment of the present invention.

Referring now to FIG. 1, there is illustrated a speech synthesizer timepiece according to a preferred embodiment of the present invention, which generally includes an instruction storage RU (program memory) typically of a read only memory, an address register RAR, an address decoder RDC and an instruction selector RUG. Decision signals $S_b$ from respective decision circuits are applied to the instruction selector, which signals $S_b$ are used to branch program steps. An instruction decoder IM develops a string of microinstructions ①, ②, . . . ⓝ and control signals $S_a$ in response to signals transferred via an instruction selection gate RUG based on the contents of the program memory RU.

The timepiece comprises components as follows for the purpose of timekeeping; a clock generator CG, a divider DV connected to the clock generator CG for developing a time standard, a timekeeping counter CO connected via a timekeeping control gate GC to the divider DV, a counter C for counting elapsed time upon actuation of a key and a decision circuit JC for deciding whether the count of the counter C reaches a predetermined count.

A selection gate G is provided for the selection of information (word codes and the results of timekeeping) to be audibly delivered. A buffer register is labeled B, a voice output control VCC and a loud speaker SP.

There is further provided a key switch T for starting the timekeeping, and a means for outputting the results of the timekeeping and delivering an audible indication of the results of the timekeeping, which plays an important role in the present invention. There are further provided a decision circuit JT for deciding if the key switch T has been actuated, a mode selector slide switch M for selecting either a normal mode or an accumulation mode discussed hereafter, a decision circuit JM for the switch M, and flip flops $F_1$ and $F_2$ with associated decision circuits $JF_1$ and $JF_2$ for deciding if the flip flops $F_1$ and $F_2$ are in the set or reset state.

Figure 2:
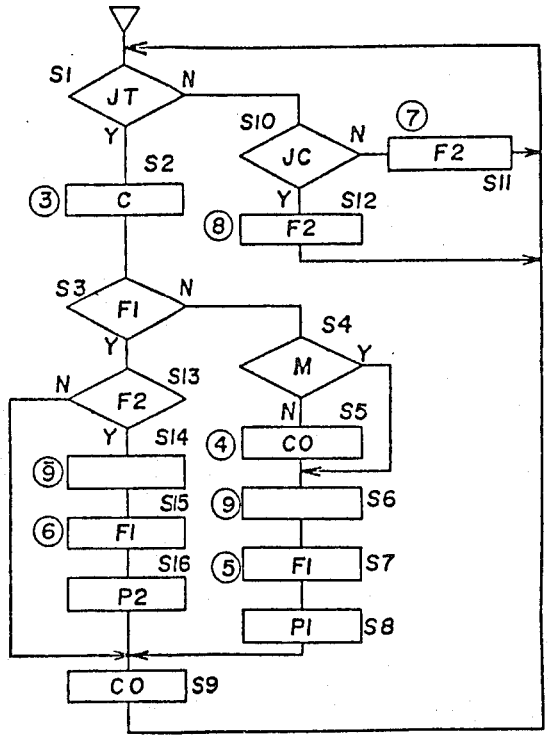
FIG. 2 is a flow chart for explanation of the operation of the circuit of FIG. 1.

FIG. 2 is a flow chart for the explanation of the operation of the circuit of FIG. 1. The illustrated embodiment has two operation modes: the normal mode by which the results of the timekeeping are cleared when the timekeeping comes into a temporary stop for any reason and the next timekeeping starts beginning with "0"; and the accumulation mode by which the results of the timekeeping are kept unchanged when the timekeeping comes into a temporary stop and the timekeeping re-starts beginning with the previous or stored count.

It is noted that the flip flops $F_1$ and $F_2$ are reset before timekeeping starts.

(1) Normal Mode

Upon actuation of the key switch T the timepiece proceeds from operation of the step $S_1$ to $S_2$. Step $S_2$ is carried out to reset the counter C (micro-instruction ③) and the next step $S_3$ is carried out to decide the operation state of the flip flop $F_1$. With the flip flop $F_1$ in the reset state, step $S_4$ is effected to decide whether the mode is in the normal mode of the accumulation mode. Step $S_5$ is effected if in the normal mode so that the counter CO is reset (micro-instruction ④). This step is followed by step $S_6$ whereby timekeeping is initiated (micro-instruction ⑨). The next step $S_7$ resets the flip flop $F_1$ (micro-instruction ⑤). Then, the step $S_8$ delivers a timekeeping start sound $P_1$ (e.g., "peep"), while step $S_9$ delivers an audible indication of the count of the counter CO (e.g., "its now 00 sec"). Thereafter, the step $S_1$ is resumed.

Unless the switch T is actuated under the circumstance, the above timepiece effects step $S_{10}$ which decides whether the count of the counter C indicates the elapse of 2 sec. Since the timepiece has just started timekeeping, the count of the counter C does not show the elapse of 2 sec and executes step $S_{11}$ wherein the flip flop $F_2$ is reset (micro-instruction ⑦). Then, it is time for execution of a loop of the steps $S_1 \rightarrow S_{10} \rightarrow S_{11} \rightarrow S_1$. After the passage of 2 sec the step $S_{10}$ senses that 2 sec have passed as decided by the count of the counter C and the step $S_{12}$ serves to reset the flip flop $F_2$ (micro-instruction ⑧). The loop of the program steps $S_1 \rightarrow S_{10} \rightarrow S_{12} \rightarrow S_1$ is repeated until the switch T is newly actuated. If the switch T is then actuated (instructing the results of timekeeping to be outputted), step $S_7$ is effected to set the flip flop $F_1$ via the steps $S_2$ and $S_3$, followed by step $S_{13}$ which senses the operating state of the flip flop $F_2$. With the flip flop $F_2$ being reset through step $S_{12}$, the timepiece proceeds with step $S_9$ for delivering an audible indication of the results of the timekeeping or updated time of the day. Then, the timepiece returns to the step $S_1$ and executes a loop of the steps $S_1 \rightarrow S_{10} \rightarrow S_{11} \rightarrow S_1 \rightarrow S_{10} \rightarrow S_{12} \rightarrow S_1$ until the switch T is newly depressed. The above-described procedure measures the so-called lap time by which to count and display the elapsed time after the first actuation of the switch T whenever the switch T is actuated.

The following will set forth the manner by which timekeeping is discontinued upon first actuation of the switch T and started begining with "0" upon the second actuation of the switch T. This routine is executed when the switch T is actuated with the flip flop $S_{11}$ in the set state during this step $S_{11}$. In other words, the situation results when the switch T is actuated sequentially twice. In this case, step $S_{13}$ provides the answer YES and leads to the step $S_{14}$ which discontinues timekeeping (micro-instruction ⑨). The flip flop $F_1$ is reset through the step $S_{15}$ (micro-instruction ⑥) and a sound $P_2$ indicating the interruption of timekeeping (e.g., "peep peep") is delivered through the step $S_{16}$. The next step $S_9$ permits an audible indication of the count of the counter CO to be delivered. If the switch T is newly depressed under this circumstance, then the flip flop $F_1$ is reset to execute the steps $S_3$ and $S_4$. Since the flip flop $F_1$ is reset through the step $S_5$, the next timekeeping starts beginning with "0" in the counter CO. In this manner, it is possible to start timekeeping beginning with the count "0" upon depression of the switch T.

(2) Accumulation Mode

This mode is substantially similar to the normal mode except for the step $S_4$ as follows. If step $S_4$ is answered YES, then step $S_6$ is effected. In this mode, the step $S_5$ is eliminated. Because of the counter CO not in the reset state, a new result timekeeping is added to the counter CO is in the stop state upon actuation of the switch T.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A speech synthesizer timepiece capable of providing an audible indication of time information comprising in combination:

a timekeeping means for performing a timekeeping operation;

a speech synthesizer means for providing an audible indication of the results from said timekeeping means; and a singular key switch means which, upon first actuation, starts a stop watch mode of operation with the development of an audible message and which, upon a second or subsequent actuation, delivers an audible readout of the elapsed time in the form of said preceding audible message.

2. The timepiece of claim 1, capable of two operational modes, a first normal mode by which the results of said timekeeping means are cleared when the timekeeping process is temporarily interrupted and the timekeeping operation of said timekeeping means begins from zero and a second accumulation mode by which the results of said timekeeping means are stored unchanged when said timekeeping means operation is temporarily interrupted and said timekeeping operation restarts from said stored results.

* * * * *